US009161413B1

(12) United States Patent
Wu et al.

(10) Patent No.: US 9,161,413 B1
(45) Date of Patent: Oct. 13, 2015

(54) CONTROL METHOD OF COLOR TEMPERATURE AND LUMINANCE FOR LED DEVICE AND CONTROL SYSTEM THEREOF

(71) Applicant: ANTEYA TECHNOLOGY CORPORATION, Kaohsiung (TW)

(72) Inventors: Ting-Feng Wu, Kaohsiung (TW); Sheng-Chieh Tseng, Kaohsiung (TW); Chin-Chen Chou, Kaohsiung (TW); Jian-An Chen, Kaohsiung (TW)

(73) Assignees: ANTEYA TECHNOLOGY CORPORATION (TW); Ting-Feng Wu (TW)

( * ) Notice: Subject to any disclaimer, the term of this patent is extended or adjusted under 35 U.S.C. 154(b) by 33 days.

(21) Appl. No.: 14/220,268

(22) Filed: Mar. 20, 2014

(51) Int. Cl.
*H05B 33/08* (2006.01)

(52) U.S. Cl.
CPC ..... *H05B 33/0866* (2013.01); *H05B 33/089* (2013.01); *H05B 33/0851* (2013.01)

(58) Field of Classification Search
None
See application file for complete search history.

(56) References Cited

U.S. PATENT DOCUMENTS

2011/0095703 A1* 4/2011 Wilson et al. ..... 315/294

* cited by examiner

*Primary Examiner* — Douglas W Owens
*Assistant Examiner* — Dedei K Hammond
(74) *Attorney, Agent, or Firm* — Hershkovitz & Associates, PLLC; Abe Hershkovitz

(57) ABSTRACT

The present invention is a control method of color temperature and luminance for an LED device and a control system thereof. The control method has the following steps: executing a cold-start motion; determining whether a warm-start motion is executed during a preset time; if yes, adjusting the color temperature of the LED device, and determining whether the warm-start motion is executed again during the preset time; if not, adjusting the luminance of the LED device, and determining whether the warm-start motion is executed again. A user can adjust the color temperature and the luminance of the LED device by turning off and on a switch of the control system.

11 Claims, 5 Drawing Sheets

CONTROL METHOD OF COLOR TEMPERATURE AND LUMINANCE FOR LED DEVICE AND CONTROL SYSTEM THEREOF

BACKGROUND OF THE INVENTION

1. Field of the Invention

The present invention relates to a light emitting diode (LED) control method, and particularly to a control method of color temperature and luminance for an LED device and a control system thereof.

2. Description of the Related Art

An LED device can emit lights of a plurality of different colors and illumination modes. Consumers can buy the LED device for their preference. The colors or illumination modes of a commercially available LED device may be adjusted. However, between the functions of colors and illumination modes, only one function can be adjusted in one LED device.

On the other hand, when the LED device has a function for adjusting the colors or the illumination modes, a controller must be mounted in the LED device. The controller can adjust the colors or the illumination modes of the LED device. A circuit of the controller is complex, and therefore the LED device with the controller becomes more expansive than the LED device without the controller. The consumers may not want to buy the LED device with the controller because of the higher prices of the LED device.

SUMMARY OF THE INVENTION

An objective of the present invention is to provide a control method of color temperature and luminance for an LED device and a control system thereof. The control method and the control system can adjust the color temperature and the luminance of the LED device by using a relative simple circuit configuration.

To achieve the foregoing objective, the present invention provides the control method of color temperature and luminance for the LED device comprising the following steps:

executing a cold-start motion of the LED device;

determining whether a warm-start motion of the LED device is executed during a preset time period;

adjusting color temperature of the LED device when the warm-start motion is executed during the preset time period;

adjusting luminance of the LED device when the warm-start motion is executed after the preset time period;

wherein the cold-start motion is that after the LED device is turned off, the LED device is turned on after a first time period; and wherein the warm-start motion is that after the LED device is turned off, the LED device is turned on during a second time period.

In the foregoing steps, the color temperature and the luminance can be exchanged.

If the warm-start motion is executed during the preset time period after the cold-start motion is executed, the LED device will enter a color temperature adjusting mode. In the color temperature adjusting mode, the user can circularly adjust the color temperature of the LED device, while the warm-start motion is executed repeatedly during the preset time period. For example, the color temperature can be adjusted from the cool white to the warm white step by step by repeatedly executing the warm-start motion during the preset time period.

If the warm-start motion is executed after the preset time period, the LED device enters a luminance adjusting mode. In the luminance adjusting mode, the user can circularly adjust the luminance of the LED device, while the warm-start motion is executed repeatedly. For example, the luminance can be adjusted from high brightness to low brightness step by step by repeatedly executing the warm-start motion.

As a whole, the user can adjust the color temperature and the luminance of the LED device by turning off and on the LED device. The user can easily adjust the color temperature and the luminance of the LED device, and a circuit of a controller of the LED device is not complex.

To achieve the foregoing objective, the present invention further provides a control system of color temperature and luminance for the LED device, the control system comprising:

a rectification circuit electronically connected with an alternating current (AC) power source for rectifying an AC of the AC power source to a full wave direct current (DC), and outputting the full wave DC;

an optical coupler having an input terminal electronically connected with the rectification circuit for detecting the full wave DC; and an output terminal outputting continuous square waves according to the full wave DC being detected;

a transforming circuit electronically connected with the rectification circuit for receiving the full wave DC and transforming the full wave DC to a stable DC voltage, and outputting the stable DC voltage;

a voltage stabilizer electronically connected with the transforming circuit for receiving the stable DC voltage and transforming the stable DC voltage to a working DC voltage;

a microprocessor electronically connected with the voltage stabilizer for receiving the working DC voltage, and connected with the output terminal of the optical coupler for receiving the continuous square waves;

wherein the microprocessor determines whether a warm-start motion is executed during a preset time period according to the continuous square waves after a cold-start motion has been detected by the microprocessor;

wherein the microprocessor outputs a first signal when the warm-start motion is executed during the preset time period, and determines whether the warm-start motion is executed during the preset time period again, and the microprocessor outputs the first signal again when the warm-start motion is executed again during the preset time period;

wherein the microprocessor outputs a second signal when the warm-start motion is executed after the preset time period, and determines whether the warm-start motion is executed again, and the microprocessor outputs the second signal again when the warm-start motion is executed again; and wherein the first signal is a color temperature adjusting signal, and the second signal is a luminance adjusting signal, or vice versa.

Other objectives, advantages and novel features of the invention will become more apparent from the following detailed description when taken in conjunction with the accompanying drawings.

DETAILED DESCRIPTION OF THE INVENTION

Figure 1:
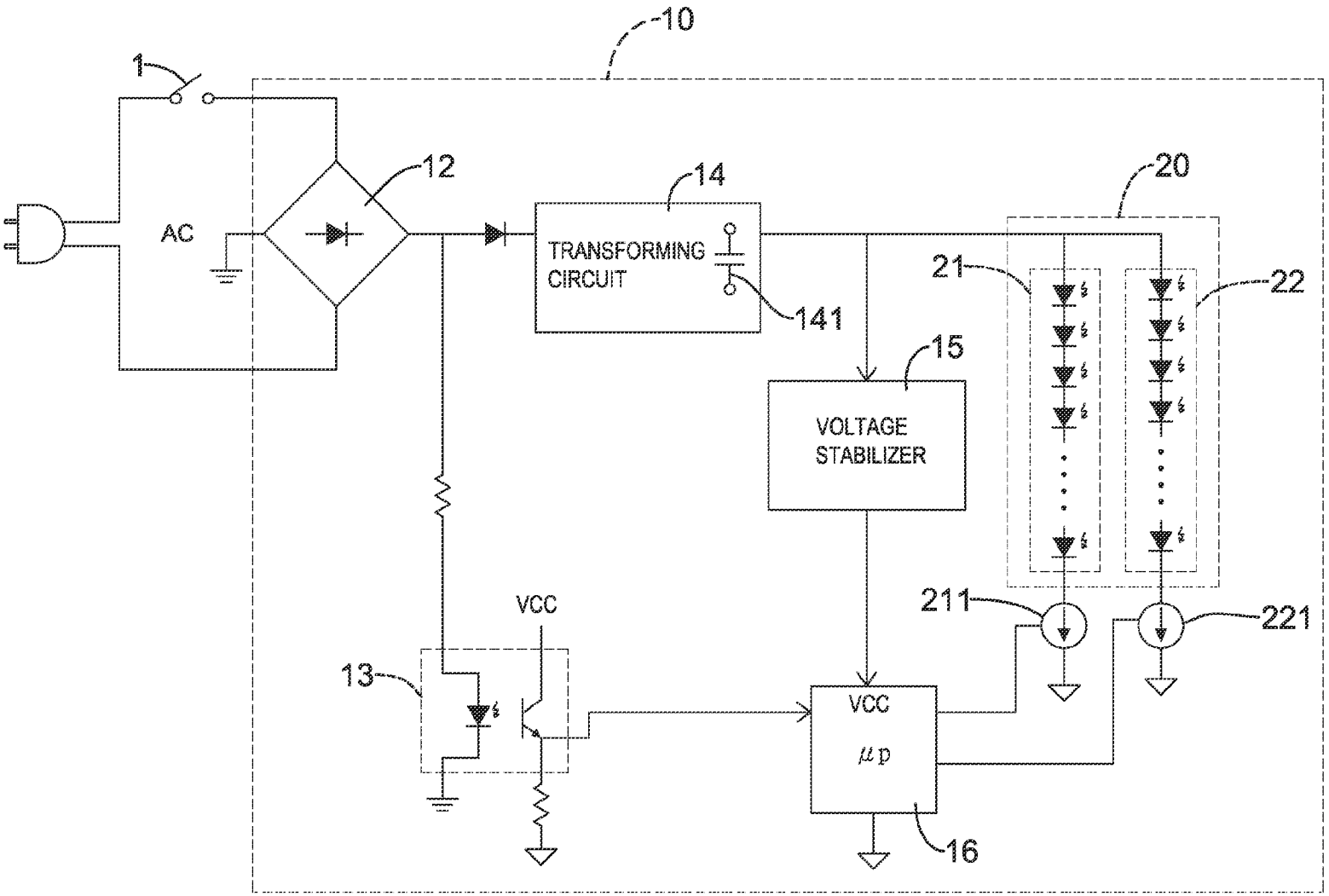
FIG. 1 is a circuit diagram of an embodiment of a control system of the present invention.

With reference to FIG. 1, the present invention provides a control system 10 of color temperature and luminance for an LED device. In an embodiment of the present invention, the control system 10 comprises a rectification circuit 12, an optical coupler 13, a transforming circuit 14, a voltage stabilizer 15, a microprocessor 16, and a switch 1.

Figure 2:
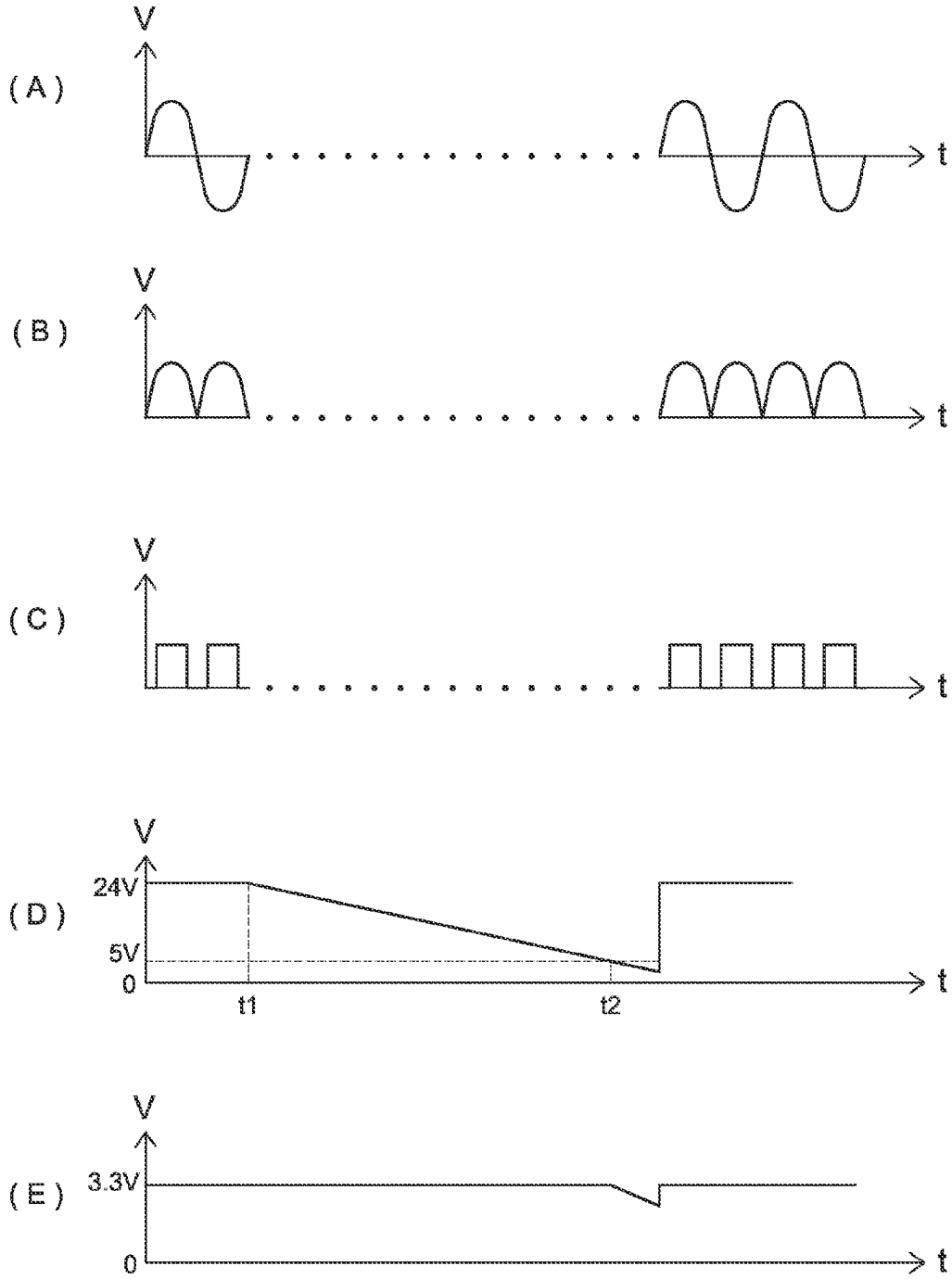
FIG. 2 shows a waveform diagram (A) of an output of an AC power source in the control system of FIG. 1, a waveform diagram (B) of an output of a rectification circuit in the control system of FIG. 1, a waveform diagram (C) of an output of an optical coupler in the control system of FIG. 1, a waveform diagram (D) of an output of a transforming circuit in the control system of FIG. 1, and a waveform diagram (E) of an output of a voltage stabilizer in the control system of FIG. 1.

With reference to FIG. 1 and FIG. 2, the switch 1 is electronically connected between an AC power source and the rectification circuit 12. When the switch 1 is turned on, the AC power source can provide electricity to a load of the control system 10, and a waveform of the AC power source is shown in a solid line of a waveform (A) in FIG. 2. When the switch 1 is turned off, the AC power source is cut off, and the waveform of the AC power source is shown in a dotted line of the waveform (A) in FIG. 2. In the embodiment, the switch 1 may be a conventional switch on a wall.

The rectification circuit 12 rectifies an AC of the AC power source to a full wave DC, and outputting the full wave DC. If the AC power source is provided by the mains electricity, a waveform of an output of the rectification circuit 12 will be a waveform of continuous positive half waves, which is called the full wave DC. When the switch 1 is turned on, the waveform of the output of the rectification circuit 12 is shown in a solid line of a waveform (B) in FIG. 2. When the switch 1 is turned off, the waveform of the output of the rectification circuit 12 is shown in a dotted line of the waveform (B) in FIG. 2.

The optical coupler 13 comprises an input terminal and an output terminal. The input terminal is electronically connected with an output of the rectification circuit 12 for detecting the full wave DC. The output terminal outputs continuous square waves according to the detected full wave DC. When the switch 1 is turned on, a waveform of the output terminal is shown in a solid line of a waveform (C) in FIG. 2. When the switch 1 is turned off, the waveform of the output terminal is shown in a dotted line of the waveform (C) in FIG. 2.

The transforming circuit 14 is electronically connected with the output of the rectification circuit 12 for receiving the full wave DC and transforms the full wave DC to a stable DC voltage, for example, 24V. A waveform of the stable DC voltage is shown in a waveform (D) in FIG. 2. The transforming circuit 14 comprises a capacitor 141. The capacitor 141 can store electrical energy when the switch 1 is turned on, and can release the electrical energy when the switch 1 is turned off. For example, when the switch 1 is turn off at a time t1 (shown in the waveform (D) in FIG. 2), the AC power source is cut off, and the capacitor 141 starts to release the electrical energy. Therefore, a voltage of the capacitor 141 will decrease after the time t1.

The voltage stabilizer 15 is electronically connected with an output of the transforming circuit 14 for receiving the stable DC voltage and transforms the stable DC voltage to a working DC voltage, for example, 3.3V. A waveform of the working DC voltage is shown in a waveform (E) in FIG. 2.

The microprocessor 16 is electronically connected with an output of the voltage stabilizer 15 for receiving the working DC voltage, and also with the output terminal of the optical coupler 13 for receiving the continuous square waves. When the switch 1 is turned off, electrical energy of the AC power source is cut off, and the optical coupler 13 stops outputting the continuous square waves. The microprocessor 16 can determine that the switch 1 is turned on or off according to whether the continuous square waves exist or not. The microprocessor 16 can change the color temperature and luminance. The microprocessor 16 has a pre-stored determining program. The microprocessor 16 can output a color temperature adjusting signal or a luminance adjusting signal according to a switching motion and the determining program for adjusting the color temperature and the luminance. The switching motion is turning on or off the switch 1. The color temperature adjusting signal is a plurality of adjusting values in a sequence. For example, the sequence of the color temperature adjusting signal may be 5500K→4000K→3300K→2700K. The luminance adjusting signal is another plurality of adjusting values in a sequence. For example, the sequence of the luminance adjusting signal may be 100%→50%→25%→10%→1%.

The control system 10 can adjust the color temperature and luminance of an LED lighting device 20. In the embodiment, the LED lighting device 20 may be a panel light, a fluorescent lamp, a projector lamp, a light bar, or a wash wall lamp. The LED lighting device 20 comprises multiple groups of LEDs. Each group of the LEDs has different color temperatures. For example, a color temperature of a first group 21 of the LEDs is 5500K, and a color temperature of a second group 22 of the LEDs is 2700K. A plurality of mixed color temperatures can be obtained by adjusting a mixing proportion of the first group of the LEDs and the second group of the LEDs. The following table is an example.

| First group of the LEDs (5500 K) | Second group of the LEDs (2700 K) | Mixed color temperature |
|---|---|---|
| 100% | 0% | 5500 K |
| 50% | 50% | 4000 K |
| 10% | 90% | 3300 K |
| 0% | 100% | 2700 K |

The first group 21 of the LEDs and the second group 22 of the LEDs are electronically connected with the output of the transforming circuit 14 for receiving the stable DC voltage. A first current control circuit 211 and a second current control circuit 221 are each respectively and electronically connected with the first group 21 of the LEDs and the second group 22 of the LEDs. An output of the microprocessor 16 outputs the color temperature adjusting signal or the luminance adjusting signal for controlling the first current control circuit 211 and the second current control circuit 221. The first current control circuit 211 can control a current of the first group 21 of the LEDs and the second current control circuit 221 can control a current of the second group 22 of the LEDs for adjusting the color temperature or the luminance of the LED lighting device 20.

In the embodiment, a user can adjust the color temperature or the luminance of the LED lighting device 20 by switching the switch 1 repeatedly. The microprocessor 16 determines whether the user adjusts the color temperature or the luminance of the LED lighting device 20 according to a warm-start motion, a cold-start motion, and a preset time period, for example, a time of correlated color temperature ($T_{cct}$). The $T_{cct}$ is a time for distinguishing a color temperature adjusting mode from a luminance adjusting mode. For example, the time of correlated color temperature is 5 seconds, and the $T_{cct}$=5.

Figure 3:
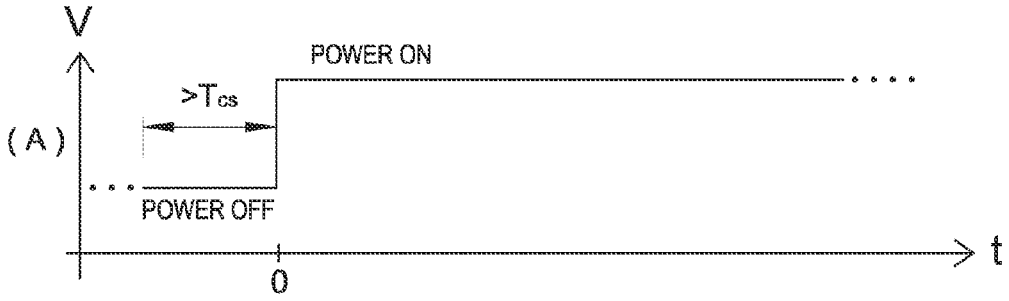
FIG. 3 shows a waveform (A) of a time diagram of the cold-start motion and a waveform (B) of a time diagram of the warm-start motion.
Figure 3:
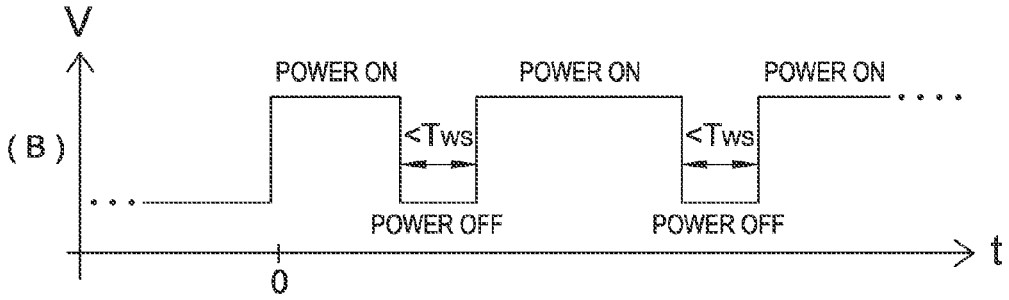

With reference to FIG. 3, the cold-start motion is that after the LED device is turned off, the LED device is turned on after a first time period, i.e., a time of cold start ($T_{cs}$). For example, the $T_{cs}$ is 8 seconds. A waveform (A) in FIG. 3 is a time diagram of the cold-start motion for reference. The warm-start motion is that after the LED device is turned off, the LED device is turned on during a second time period, i.e., a time of warm start ($T_{ws}$). For example, the $T_{ws}$ is 2 seconds. A waveform (B) in FIG. 3 is a time diagram of the warm-start motions, wherein $T_{cs}>T_{ws}$.

With reference to the waveform (D) in FIG. 2, when the switch 1 is turned on, the AC power source can provide electricity to the control system 10, and the transforming circuit 14 can output the stable DC (For example, 24V) voltage continuously.

When the switch 1 is turned off at the time t1, the optical coupler 13 stops outputting the continuous square waves, and the capacitor 141 of the transforming circuit 14 starts to release the electrical energy. The microprocessor 16 detects whether the AC power source is cut off according to the optical coupler 13. When the AC power is cut off at the time t1, the voltage stabilizer 15 can still output the working DC voltage (For example, 3.3V) according to the electrical energy released by the capacitor 141. When the switch 1 is still off at a time t2, the capacitor 141 is running out of its electricity energy. An output voltage of the transforming circuit 14 cannot be provided to the voltage stabilizer 15 for outputting the working DC voltage. For example, when the output voltage of the transforming circuit 14 is lower than 5V, the voltage stabilizer 15 stops working, and the microprocessor 16 stops working. In another situation, when the switch 1 is turned off at the time t1 and turned on before the time t2, the microprocessor 16 remains working. Therefore, if the switch 1 is turned off at the time t1 and then turned on before the time t2, the activation of the switch 1 is regarded as the warm-start motion. A time period between the time t1 and time t2 is the time period $T_{ws}$. A duration of the time period $T_{ws}$ is decided by capacitance of the capacitor 141.

When the switch 1 is still not turned on during the $T_{cs}$, the capacitor 141 is running out of the electricity energy, and the voltage stabilizer 15 and the microprocessor 16 stop working. When the switch 1 is turned off and then turned on after the $T_{cs}$, the microprocessor 16 is reset and restarted. Therefore, if the switch 1 is turned off and then turned on after the $T_{cs}$, the activation of the switch 1 is regarded as the cold-start motion.

Furthermore, in the other embodiment, when the warm-start motion is executed without determining whether the warm-start motion is executed during the $T_{cct}$, the microprocessor 16 can output an adjusting signal for simultaneously adjusting the color temperature and the luminance of the LED device. The adjusting signal is a plurality of sets of adjusting values changed sequentially. The adjustment of the color temperature and the luminance are executed circularly according to a sequence. For example, the sequence has eight sets of the adjusting values, and the color temperature and the luminance are adjusted according to the sets of the adjusting values form the first set to the eighth set. If the last set, i.e. the eighth set, is currently used, switching to a next set following the eighth set will return to the first set. The color temperature and the luminance are repeatedly adjusted according to the sets of the adjusting values from the first set to the eighth set.

The following table is the example of the eight sets of the adjusting values in the sequence.

| Sequence | Color temperature | Luminance |
|---|---|---|
| $1^{st}$ | 5500 K | 100% |
| $2^{nd}$ | 5500 K | 80% |
| $3^{rd}$ | 4000 K | 60% |
| $4^{th}$ | 4000 K | 40% |
| $5^{th}$ | 3300 K | 30% |
| $6^{th}$ | 3300 K | 20% |
| $7^{th}$ | 2700 K | 10% |
| $8^{th}$ | 2700 K | 1% |

The example described above may produce a light variation curve of sunlight from noon to dusk. The first set of the adjusting values corresponds to 5500K (cool whtie) of the color temperature and 100% of the luminance, and the first set simulates the sunlight of noon. Then the fourth set of the adjusting values corresonds to 4000K (natural white) of the color temperature and 40% of the luminance for simulating the sunlight of afternoon. The eighth set of the adjusting values corresponds to 2700K (warm whtie) of the color temperature and 1% of the luminance for simulating the sunlight of dusk.

The light variation curve of sunlight from noon to dusk can produce comfortable luminous environments.

Figure 4:
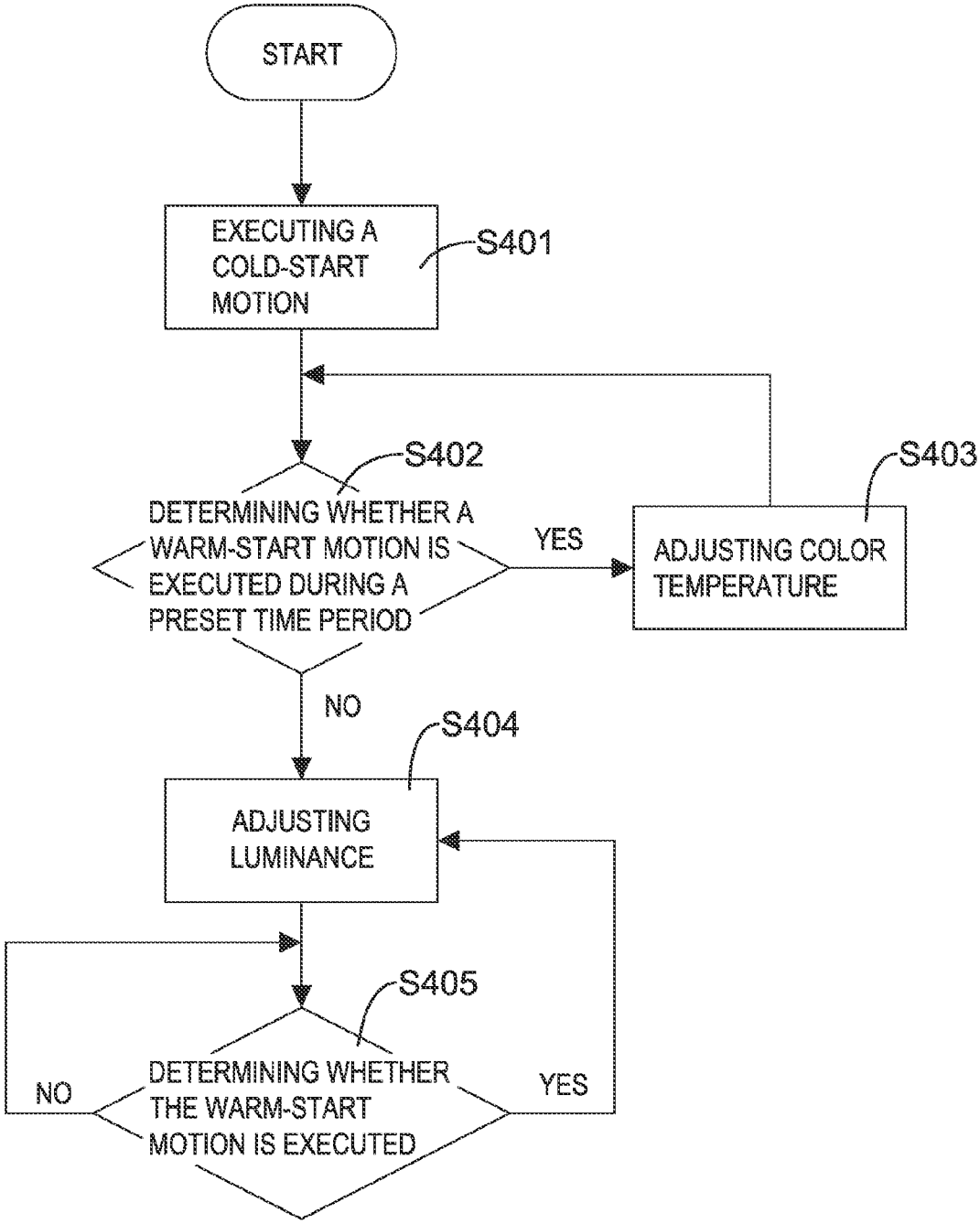
FIG. 4 is a flow chart of a control method of the present invention.

With reference to FIG. 4, the present invention provides a control method of the color temperature and the luminance for the LED device, the control method comprising the following steps:

executing a cold-start motion (S401);

determining whether a warm-start motion is executed during a preset time period, $T_{cct}$ (S402);

adjusting color temperature of the LED device (S403) when the warm-start motion is executed during the preset time period, $T_{cct}$, and returning to the step S402, wherein when the warm-start motion is executed again during the preset time period, $T_{cct}$, the color temperature is also adjusted again; wherein the color temperature is adjusted circularly in a sequence, for example, the sequence of the color temperature may be 5500K→4000K→3300K→2700K;

adjusting luminance of the LED device (S404) when the warm-start motion is not executed during the preset time period, $T_{cct}$;

determining whether the warm-start motion is executed (S405) after the luminance has been previously adjusted, wherein when the warm-start motion is detected, the step S404 is executed again to adjust the luminance.

The luminance is also adjusted circularly in a sequence, for example, the sequence of the luminance may be 100%→50%→25%→10%→1%.

In another embodiment, the color temperature and the luminance can be exchanged. In more detail, the luminance of the LED device is adjusted (S403) when the warm-start motion is executed during the preset time period, $T_{cct}$, and when the warm-start motion is executed again during the preset time period, $T_{cct}$, the luminance of the LED device is also adjusted again. The luminance is adjusted circularly in a sequence, for example, the sequence of the luminance may be 100%→50%→25%→10%→1%. The color temperature of the LED device is adjusted (S404) when the warm-start motion is not executed in the preset time period, $T_{cct}$, and when the warm-start motion is detected again (S405), the color temperature of the LED device is also adjusted again (S404). The color temperature is adjusted circularly in a sequence, for example, the sequence of the color temperature may be 5500K→4000K→3300K→2700K.

In the other embodiment, the control method can be executed by the following steps:

executing a cold-start motion;

determining whether a warm-start motion is executed;

simultaneously adjusting color temperature and luminance of the LED device when the warm-start motion is executed;

determining whether the warm-start motion is executed; and when the warm-start motion is detected, the color temperature and the luminance of the LED device is adjusted again;

wherein the color temperature and the luminance of the LED device are adjusted circularly in a sequence.

For example, the sequence has eight sets of the color temperature and the luminance, and the color temperature and the luminance are adjusted form the first set to the eighth set. Then, a next set after the eighth set will return to the first set, and the color temperature and the luminance are repeatedly adjusted from the first set to the eighth set.

The following table is the example of sets of the color temperature and the luminance in the sequence.

| Sequence | Color temperature | Luminance |
|---|---|---|
| $1^{st}$ | 5500 K | 100% |
| $2^{nd}$ | 5500 K | 80% |
| $3^{rd}$ | 4000 K | 60% |
| $4^{th}$ | 4000 K | 40% |
| $5^{th}$ | 3300 K | 30% |
| $6^{th}$ | 3300 K | 20% |
| $7^{th}$ | 2700 K | 10% |
| $8^{th}$ | 2700 K | 1% |

Figure 5:
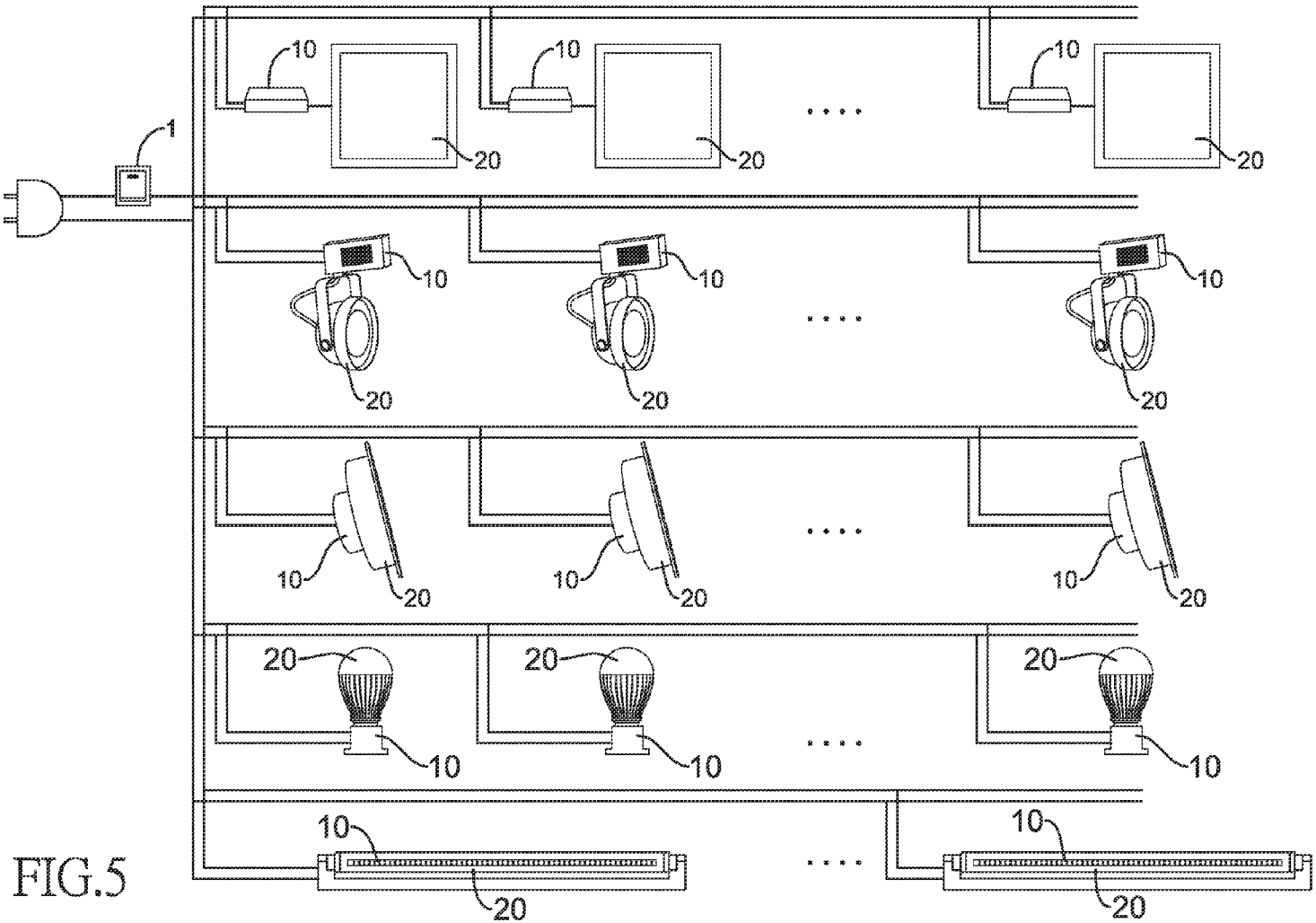
FIG. 5 is a schematic diagram for embodiments of the present invention adapted to different LED devices.

With reference to FIG. 5, a circuit of the control system 10 may be a control box, and the control box is electronically connected with the LED lighting device 20. A portion of the circuit of the control system 10 may be integrated with an inner circuit of the LED lighting device 20. A user can adjust the color temperature and the luminance of the LED lighting device 20 by turning off and on the switch 1.

The present invention can adjust the color temperature and the luminance of the LED device by turning off and on the switch 1. The circuit of the control system 10 is not complex, and does not require a complex wiring. The present invention lowers cost in manufacturing, simplifies a manufacturing process, and can adjust both the color temperature and the luminance of the LED device.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A control method of color temperature and luminance for a light emitting diode (LED) device, the control method comprising the following steps:

executing a cold-start motion of the LED device;

determining whether a warm-start motion of the LED device is executed during a preset time period;

adjusting color temperature of the LED device when the warm-start motion is executed during the preset time period;

adjusting luminance of the LED device when the warm-start motion is executed after the preset time period;

wherein the cold-start motion is that after the LED device is turned off, the LED device is turned on after a first time period;

wherein the warm-start motion is that after the LED device is turned off, the LED device is turned on during a second time period; and wherein the first time period is larger than the second time period.

2. The control method as claimed in claim 1, wherein after the step of adjusting the color temperature of the LED device, the control method further comprises the following steps:

determining circularly whether the warm-start motion of the LED device is executed during the preset time period; and adjusting the color temperature of the LED device circularly when the warm-start motion is executed during the preset time period.

3. The control method as claimed in claim 1, wherein after the step of adjusting the luminance of the LED device, the control method further comprises the following steps:

determining circularly whether the warm-start motion of the LED device is executed; and adjusting the luminance of the LED device circularly when the warm-start motion of the LED device is executed.

4. A control method of color temperature and luminance for an LED device, the control method comprising the following steps:

executing a cold-start motion of the LED device;

determining whether a warm-start motion of the LED device is executed; simultaneously adjusting luminance and color temperature of the LED device when the warm-start motion is executed;

determining whether the warm-start motion is executed; and when the warm-start motion is detected, the color temperature and the luminance of the LED device is adjusted again;

wherein the cold-start motion is that after the LED device is turned off, the LED device is turned on after a first time period; and wherein the warm-start motion is that after the LED device is turned off, the LED device is turned on during a second time period.

5. The control method as claimed in claim 4, wherein the luminance and the color temperature are adjusted circularly in a sequence.

6. The control method as claimed in claim 4, wherein the color temperature is adjusted form cool white to warm white, and simultaneously the luminance is adjusted form 100% to 1%; and wherein the luminance and the color temperature are adjusted for simulating the sunlight form noon to dusk.

7. A control system of color temperature and luminance for an LED device, the control system comprising:

a rectification circuit electronically connected with an alternating current (AC) power source for rectifying an AC of the AC power source to a full wave direct current (DC), and outputting the full wave DC;

an optical coupler having an input terminal electronically connected with the rectification circuit for detecting the full wave DC; and an output terminal outputting continuous square waves according to the full wave DC being detected;

a transforming circuit electronically connected with the rectification circuit for receiving the full wave DC and transforming the full wave DC to a stable DC voltage, and outputting the stable DC voltage;

a voltage stabilizer electronically connected with the transforming circuit for receiving the stable DC voltage and transforming the stable DC voltage to a working DC voltage;

a microprocessor electronically connected with the voltage stabilizer for receiving the working DC voltage, and connected with the output terminal of the optical coupler for receiving the continuous square waves;

wherein the microprocessor determines whether a warm-start motion is executed during a preset time period according to the continuous square waves after a cold-start motion has been detected by the microprocessor;

wherein the microprocessor outputs a first signal when the warm-start motion is executed during the preset time period, and determines whether the warm-start motion is executed during the preset time period again, and the microprocessor outputs the first signal again when the warm-start motion is executed during the preset time period again;

wherein the microprocessor outputs a second signal when the warm-start motion is executed after the preset time period, and determines whether the warm-start motion is executed again, and the microprocessor outputs the second signal again when the warm-start motion is executed again; and wherein the first signal is a color temperature adjusting signal, and the second signal is a luminance adjusting signal, or vice versa.

8. The control system as claimed in claim 7, wherein the cold-start motion is that after the LED device is turned off, the LED device is turned on after a first time period; and wherein the warm-start motion is that after the LED device is turned off, the LED device is turned on during a second time period.

9. An LED device with a control system of color temperature and luminance, the LED device comprising:

a rectification circuit rectifying an alternating current (AC) of an AC power source to a full wave direct current (DC), and outputting the full wave DC;

a switch electronically connected between the rectification circuit and the AC power source;

an optical coupler having an input terminal electronically connected with the rectification circuit for detecting the full wave DC; and an output terminal outputting continuous square waves according to the full wave DC being detected;

a transforming circuit electronically connected with the rectification circuit for receiving the full wave DC and transforming the full wave DC to a stable DC voltage, and outputting the stable DC voltage;

a voltage stabilizer electronically connected with the transforming circuit for receiving the stable DC voltage and transforming the stable DC voltage to a working DC voltage;

a microprocessor electronically connected with the voltage stabilizer for receiving the working DC voltage, and connected with the output terminal of the optical coupler for receiving the continuous square waves;

an LED lighting device comprising multiple groups of LEDs having different color temperatures, and each group of the LEDs electronically connected with the rectification circuit for receiving the full wave DC;

wherein the microprocessor determines whether a warm-start motion is executed during a preset time period according to the continuous square waves after a cold-start motion has been detected by the microprocessor;

wherein the microprocessor outputs a first signal when the warm-start motion is executed during the preset time period, and determines whether the warm-start motion is executed during the preset time period again, and the microprocessor outputs the first signal again when the warm-start motion is executed during the preset time period again;

wherein the microprocessor outputs a second signal when the warm-start motion is executed after the preset time period, and determines whether the warm-start motion is executed again, and the microprocessor outputs the second signal again when the warm-start motion is executed again;

wherein each group of the LEDs is electronically connected with the microprocessor for receiving the first signal and the second signal; and wherein the first signal is a color temperature adjusting signal, and the second signal is a luminance adjusting signal, or vice versa.

10. The LED device as claimed in claim 9, wherein the LED lighting device may be a panel light, a fluorescent lamp, a projector lamp, a light bar, or a wash wall lamp.

11. The LED device as claimed in claim 9, wherein the cold-start motion is that after the LED device is turned off, the LED device is turned on after a first time period; and wherein the warm-start motion is that after the LED device is turned off, the LED device is turned on during a second time period.

* * * * *